US010414060B2

(12) United States Patent
Koebke

(10) Patent No.: US 10,414,060 B2
(45) Date of Patent: Sep. 17, 2019

(54) DIE ATTACH SOLDER PREFORM CUTTER

(71) Applicant: U.S. Army Research Laboratory ATTN: RDRL-LOC-I, Adelphi, MD (US)

(72) Inventor: M. Gail Koebke, Chesapeake Beach, MD (US)

(73) Assignee: America as reprecented by the Secretary of the Army, Washington, DC (US)

( * ) Notice: Subject to any disclaimer, the term of this patent is extended or adjusted under 35 U.S.C. 154(b) by 93 days.

(21) Appl. No.: 14/831,585

(22) Filed: Aug. 20, 2015

(65) Prior Publication Data

US 2016/0031105 A1 Feb. 4, 2016

(51) Int. Cl.

| | |
|---|---|
| ***B26D 1/04*** | (2006.01) |
| ***B26D 1/01*** | (2006.01) |
| ***B26D 7/00*** | (2006.01) |
| ***B26F 1/44*** | (2006.01) |

(52) U.S. Cl.

CPC ..... *B26D 1/015* (2013.01); *B26D 1/04* (2013.01); *B26D 7/0006* (2013.01); *B26F 1/44* (2013.01)

(58) Field of Classification Search

CPC ..... B26D 1/015; B26D 1/04; B26D 7/0006; B26F 1/44

See application file for complete search history.

(56) References Cited

U.S. PATENT DOCUMENTS

| | | | | | |
|---|---|---|---|---|---|
| 173,587 | A * | 2/1876 | Clarke | B26D 5/08 | 83/625 |
| 653,928 | A * | 7/1900 | Dixon | B26F 1/36 | 83/588 |
| 1,864,404 | A * | 6/1932 | Bradshaw | B26D 7/30 | 83/437.5 |
| 2,090,471 | A * | 8/1937 | Coffey | B28D 1/26 | 125/23.01 |
| 2,653,594 | A * | 9/1953 | Findley | B28D 1/223 | 125/23.01 |

(Continued)

FOREIGN PATENT DOCUMENTS

JP 05-293694 11/1993

OTHER PUBLICATIONS

Dimeji Ibitayo, Gail Koebke, Damian Urciuloi, and C. Weslet Tipton, "Fabrication of High-Voltage Bridge Rectifier Modules for Pulse Power Applications," U.S. Army Research Laboratory, ARL-MR-0877 (Sep. 2014).

(Continued)

*Primary Examiner* — Kenneth E Peterson
*Assistant Examiner* — Liang Dong
(74) *Attorney, Agent, or Firm* — Eric Brett Compton

(57) ABSTRACT

A cutter to cut die attach solder preform material is disclosed. It is formed of: a base; a pair of raised blocks spaced apart on the base with each having a slot sized to accommodate a cutting blade configured to cleave the material to be cut, constrain the cutting blade to vertical movement, and maintain the squareness of the cutting blade with respect to the base for cutting material; an adjustable stop positioned forward of the cutting blade which is configured to be moved so as to set the length of the material to be cut by the cutting blade; and a linear scale positioned proximate to the adjustable stop which enables a measured length of the material to be cut. Methods of using the aforementioned cutter are also disclosed.

23 Claims, 9 Drawing Sheets

(56) References Cited

U.S. PATENT DOCUMENTS

| | | | | | |
|---|---|---|---|---|---|
| 2,814,113 | A * | 11/1957 | Morlacchi | A01J 23/00 | 83/437.2 |
| 3,768,357 | A * | 10/1973 | McBride | B26D 3/02 | 83/438 |
| 4,944,446 | A | 7/1990 | Thompson | | |
| 5,662,094 | A * | 9/1997 | Giacomelli | B28D 1/223 | 125/23.01 |
| 5,904,084 | A * | 5/1999 | Weston | B26D 7/025 | 83/373 |
| 7,755,292 | B1 * | 7/2010 | Tuma | G01J 3/10 | 313/238 |
| 8,061,578 | B2 * | 11/2011 | Hartnett | B23K 35/0244 | 228/246 |
| 2010/0170374 | A1 * | 7/2010 | Galas | B23D 51/02 | 83/13 |

OTHER PUBLICATIONS

Duplicutter II product information. Micro-Mark website, Micromark.com. Available at: http://www.micromark.com/ duplicutter-ii,8340.html (Accessed Mar. 17, 2105).

"Metal Thermal Interface Materials" brochure. Indium Corporation. Copy available at: http://www.tomo-e.co.jp/cmsfiles/product/i-CYbPQ-r1.pdf (Accessed Mar. 17, 2015).

Model Railroader Magazine blog. Post by—E-C-Mills on Thursday, Sep. 25, 2014 10:28 PM. Available at: http://cs.trains.com/mrr/f/11/t/188631.aspx?sortorder=desc.

"Making Chain Link Fence," T-Trak Model Railroading blog. Available at: http://ttrak.wikidot.com/making-chain-link-fence (Accessed Mar. 17, 2015).

"Combination Log Splitter/ Bar Cutter," SoapHutch blog. Available at: http://www.soaphutch.com/cutters.html (Accessed Mar. 17, 2015).

"Tools, Glues and other Handy Potion" NGtrains.com. ("Tools" section). Available at: http://www.ngtrains.com/Pages/Glues/gluestools.html (Accessed Mar. 17, 2015).

"Solder Ribbon Kits," buy.solder.com. Available at: http://buy.solder.com/Solder-Ribbon/C1014_1/ (Accessed Mar. 17, 2015).

Automatic Solder Ribbon Cutting Machine. Alibaba.com. Available at: http://www.alibaba.com/product-detail/Automatic-Solder-Ribbon-Cutting-Machine_60160419997.html?spm=a2700.7724857.35.1.DuQ2ON (Accessed Mar. 17, 2015).

"Ribbon and Foil." Indium Corporation. ©1996-2015. Available at: http://www.indium.com/solders/ribbon-and-foil/.

* cited by examiner

DIE ATTACH SOLDER PREFORM CUTTER

GOVERNMENT INTEREST

The invention described herein may be manufactured, used and licensed by or for the U.S. Government without the payment of royalties thereon.

BACKGROUND OF THE INVENTION

Field

The present invention relates to cleaving die attach solder preform material, and more particularly, to cutters configured for cleaving die attach solder preform material and methods of cleaving the same.

Description of Related Art

Solder preform material is used as a die attach in packaging electronic chip components. Many solder alloys are commercially available as die attach performs; they are generally manufactured using a stamp and die cut to standard sizes. An example of a common size is 4 mm×4 mm, for instance. Present die attach fabrication technology, though, requires large machinery and specialized tools to manufacture individual stamp and die sets to cut specific sized solder preforms. This type of machinery is large and heavy and thus requires a dedicated area within a workshop or factory. In addition, the process of making the stamp and die sets requires the use of cutting oil to machine the parts. Solvents are needed to clean the machined parts prior to stamping the preforms to prevent contaminating the preform. Some environmental impact may exist with this method.

At times, there may be a need for custom die attach solder material on an ad hoc basis, especially, in a research and development (R&D) environment. But, this may not be cost effective. For instance, in the R&D environment the required quantity for any given size of preform may be quite small since R&D differs greatly from large scale commercial packaging quantities. Also, a commercial manufacturer will require a minimum order, and require several weeks lead time, in addition to a set-up charge for producing performs costing thousands of dollars.

A simple tool for cutting solder material would be useful. Unfortunately, brittle solders, such as gold/tin alloys, cannot be cut with scissors to specific dimensions from larger pieces of material as doing so will cause the brittle material to shatter rather than be cut to a desired size.

BRIEF SUMMARY OF THE INVENTION

Embodiments of the present invention are generally directed to cleaving die attach solder preform material, and more particularly, to cutters configured for cleaving die attach solder preform material and methods of cleaving the same.

According to an embodiment, a cutter to cut die attach solder preform material comprises: a base; a pair of raised blocks spaced apart on the base with each having a slot sized to accommodate a cutting blade configured to cleave the material to be cut, constrain the cutting blade to vertical movement, and maintain the squareness of the cutting blade with respect to the base for cutting material; an adjustable stop positioned forward of the cutting blade which is configured to be moved so as to set the length of the material to be cut by the cutting blade; and a linear scale positioned proximate to the adjustable stop which enables a measured length of the material to be cut.

The base may include one or more slots and the adjustable stop can include corresponding one or more projections which slide in the at least one slot of the base. For instance, the one or more projections may accommodate a screw which engages a corresponding nut held on a slot on the bottom surface of the base.

The cutter may further include one or more adjustable lateral guides which maintain the material to be cut in substantially perpendicular alignment with respect to the cutting blade. In some instances, the one or more adjustable lateral guides are positioned rearward of the cutting blade. The base can include one or more slots and the one more adjustable lateral guides includes corresponding one or more projections which slide in the at least one slot of the base. The one or more projections can accommodate a screw which engages a corresponding nut held on a slot on the bottom surface of the base.

The cutter can further include a cutting blade which is removable from the cutting device. For instance, the cutting blade may have a single cutting edge. A hammer or other weighted object can be used to strike the cutting blade in order to initiate cleaving of the material. The weight and/or frictional engagement of the cutting blade material with the material to be cut and the raised blocks help maintain the alignment of the cutting blade with respect to the material prior to cutting. The cutter may further include one or more lateral guides which maintain the material to be cut in substantially perpendicular alignment with respect to the cutting blade. Tolerances of the cutter are such that the material cleaved are 85% to 90% of desired size, for example. The base is flat beneath the cutting blade and material cut so as to maintain the material to be cut in a constant relationship with the cutting blade. The cutter may further comprise a hard plate attached to and flush with the base below the cutting blade. In some embodiments, the base and raised blocks are integrally formed by 3D printing.

According to other embodiments, a method of cleaving solder preform material is performed using the aforementioned cutter. The method comprises: inserting solder preform material into the cutter; and cleaving said solder perform material to a predetermined length. The solder perform cut can be formed of gold/tin alloy, for example. The solder perform can be ribbon material. The method further includes using a hammer or weighted object to strike the cutting blade for cleaving the material. Also the method can comprise: inserting the cut solder preform material back in the cutter; and cleaving the cut solder perform material again.

According to further embodiments, a kit comprises the aforementioned cutter along with one or more removeable cutting blades, and an optional hammer or weighted object for striking a cutting blade for cleaving solder preform material. The kit may further comprise: solder preform material.

These and other embodiments of the invention are described in more detail, below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments, including less effective but also less expensive embodiments which for some applications may be preferred when funds are limited. These embodiments are intended to be included within the following description and protected by the accompanying claims.

FIG. 3(A) shows a top isometric view, FIG. 3(B) shows a bottom isometric view, FIG. 3(C) shows a top plan view, and FIG. 3(D) shows a bottom plan view thereof.

FIG. 4(A) shows a top isometric view, FIG. 4(B) shows a bottom isometric view, FIG. 4(C) shows a top plan view, and FIG. 4(D) shows a bottom plan view thereof.

In FIG. 6(A), the adjustable guide is initially set for making a first set of cuts. FIG. 6(B) shows the result of the first set of cuts. FIG. 6(C) shows the adjustable guide is set to making the second set of cuts and the finished cut preforms.

FIG. 7(A) shows the top edge of the cutting blade immediately before being tapped with a hammer to initiate cleaving of the solder preform material. FIG. 7(B) shows the solder preform material after it has been cleaved.

DETAILED DESCRIPTION

A solder preform is material used to attach devices to various types of substrates, known in the art as "die attach." Individual electrical devices come in a large range of sizes, with each device requiring a specific preform size to optimally attach the die to a substrate. Stock solder materials are available in the form of ribbons, rolls, or small sheets. Typical thicknesses of die attach solder preforms range from about 0.001"-0.004", though not exclusive of other thicknesses.

Table I, below, details some physical and mechanical properties of various commercially-available die attach solder preform materials sold by Indium Corporation. As will be appreciated. The Au80Sn20 material, in particular, is an extremely hard, brittle alloy; it has a very high tensile strength of 40,000 (and a Brinell hardness of about 165).

TABLE I

| Material | Indium Corp Indalloy No. | Solid/Liquid Eutectic (° C.) | Tensile Strength PSI | Density gm/cm$^3$ | Thermal Conductivity W/mK | Thermal Expansion Coef. (CTE) |
|---|---|---|---|---|---|---|
| Au80Sn20 | 182 | 280 E | 40,000 | 14.51 | 57 | 16 |
| Au88Ge | 183 | 356 E | 26,835 | 14.67 | 44 | 13 |
| Au96.76/Si | 184 | 363 E | 36,975 | 15.40 | 27 | 12 |
| SAC305 | 241 | 217 E | 7,110 | 7.4 | 58 | 21.6 |
| Sn63Pb | 106 | 183 E | 7,500 | 8.4 | 50 | 25 |
| Pb95Sn | 171 | 308/312 | 4,000 | 11.06 | 23 | 30 |

The size of a solder preform is dictated by the size of the device being packaged; it is not a one-size-fits-all requirement. For many applications, such as in an R&D laboratory, the size of devices changes frequently and testing may be performed on only a small number device (typically about 25-50) of any given size. Therefore, many sizes of preforms are needed, and the capability of cutting the number of preforms required to an exact size necessary is beneficial.

Cutting thin, brittle, die attach solder preform material is difficult and cannot be effectively achieved with conventional cutting techniques used for cutting paper, cardboard, thin strips of wood, metal and plastic, or the like. As previously stated, AuSn alloy is an extremely brittle metal that easily shatters when attempts are made to cut it by hand or with a scissors action tool. If the material does not break into small pieces during the cutting process, the edges are usually very ragged and uneven.

Figure 1:
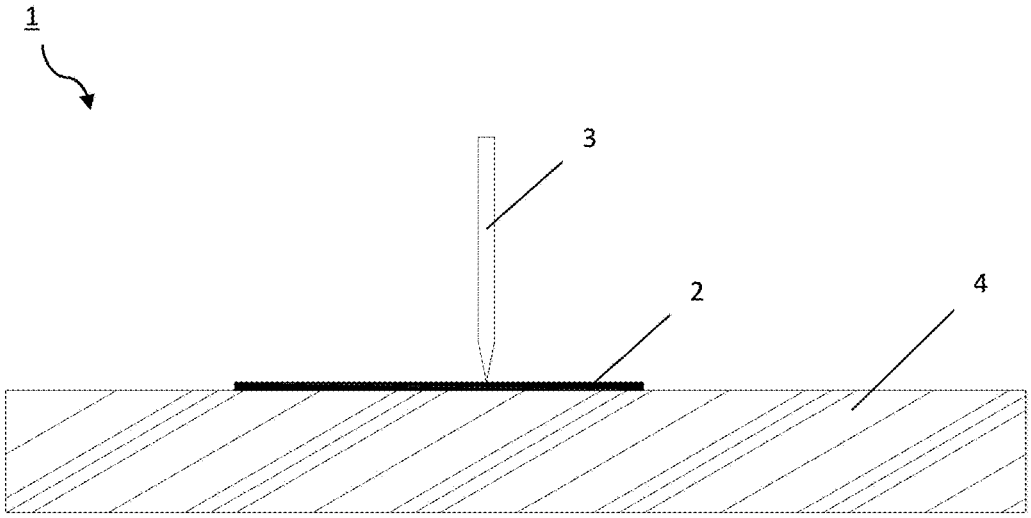
FIG. 1 shows a schematic of cleaving thin, brittle, die attach solder preform material.

Rather, than using traditional cutting, a cleaving process is used according to embodiments of the present invention. FIG. 1 shows a schematic of cleaving thin, brittle, die attach solder preform material. The cutting blade 1 is shown resting on the die attach solder preform material 2 prior to cleaving with a cutting blade 3. A base 4 supports the solder preform material 2 to be cleaved. Because of the high hardness of the preform material, the cutting blade 3 does not initially pre-cut (or "dig") into the solder preform material 2 as one might expect with a softer material thus creating self-alignment of the blade and an eased guide-way for the blade to follow with relative little force to sustain cutting. An impulsive force is generally required to initiate cleaving of the material. For instance, a hammer or other weighted object can be used to strike the cutting blade 1. Once the cut is initiated by the impulsive force, the cutting blade cleaves through the material, typically along a crystalline plane of the material. This is not gradual cutting as in a traditional cutting or shearing process in which the blade continuously cuts as it passes through the material. Instead, it is believed that the cutting process generates a crack propagating ahead of the cutting blade in the direction of cutting.

It is absolutely necessary for a solder preform to be clean before it is used to attach a device; no exceptions. It needs to be free of particles, and any other contaminants. A contaminated preform will cause voids in the solder, and will interfere with the "wetting" of the solder between the device and the substrate. Wetting is the spreading out of the solder during its melting phase. The preferred, and probably most utilized method of handling solder preform material is with gloves to avoid contamination. A person may or may not start out using tweezers to handle the solder material; it could depend on the size of the starting piece of solder. Typically, a solder preform goes through a thorough cleaning process before it is used to ensure it is contaminant and particle free. This cleaning process could include solvent cleaning with alcohol or acetone to remove organic contamination, or plasma cleaning to remove oxidation, and maybe both depending on the solder alloy composition. The cleaving process should not expose the preform material to contaminants. In other words, particles of lint, wood, soap, oil, or other chemical residue should not be introduced on the solder preform material by cleaving it with an apparatus that has been contaminated.

Figure 2:
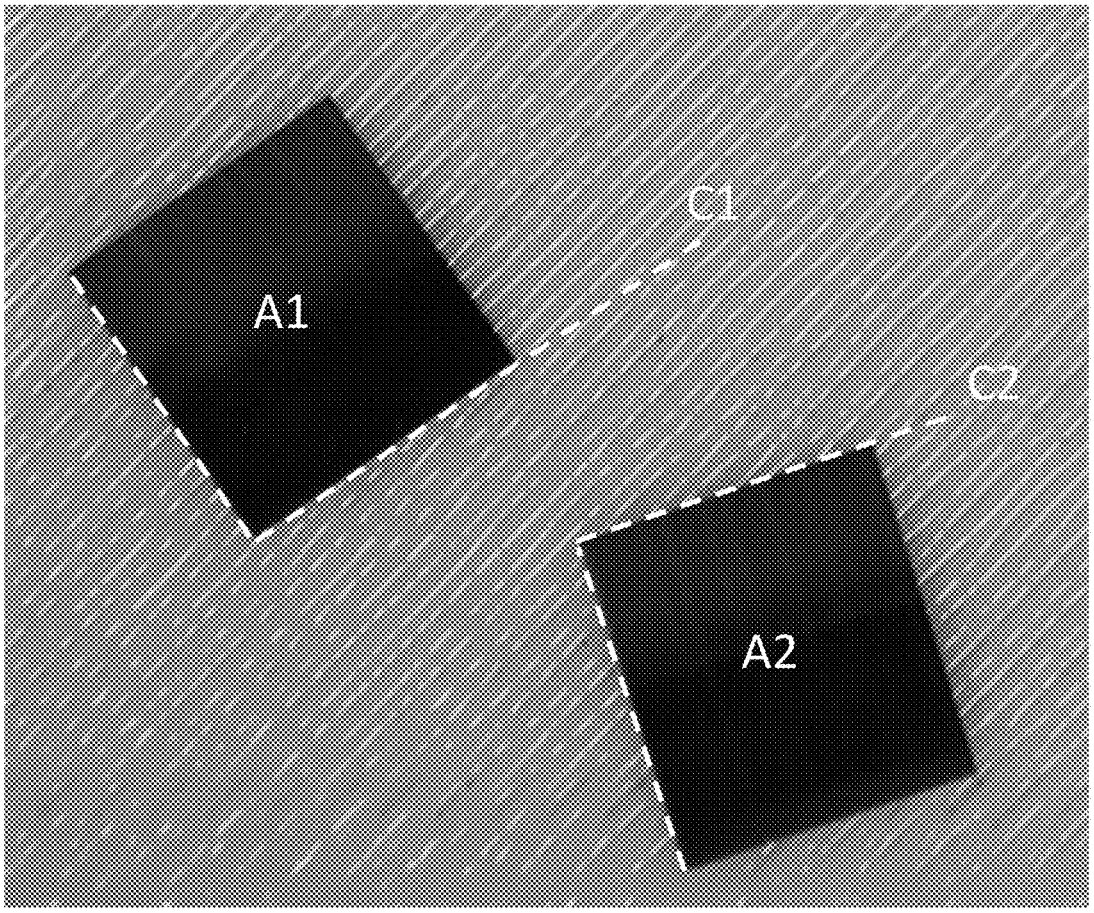
FIG. 2 is a photograph showing a solder preform having been cleaved in two pieces.

FIG. 2 is a photograph showing a solder preform having been cleaved in two pieces A1 and A2. There is a nice clean break where the perform material was cleaved along cut-lines C1 and C2. A true square sided preform is optimum to achieve a uniform and reliable die attach with cut-lines C1 and C2 each being nearly perpendicular. Basic die attach process requires that the preform be "centered" under the device prior to reflow (heating and melting) so the solder will flow out evenly, in all directions, under the device being soldered (attached). Each device (die) has an optimum size preform requirement. Industry standard dictates a preform size of about 85% to 90% of the device size for die attach. The acceptable size range is dictated by the thickness of the preform being used, it is not a range that permits a deviation from shape. For instance, a 0.002" preform would require a larger piece than a 0.004" preform since there is more material within the 0.004" thickness.

If the preform is not squared, relative to the size of the electrical device, the melting solder would not flow out evenly, which would result in poor solder coverage under the device. Non-uniform solder will result in hot-spots within the active device, and will not permit an even flow of current to the device during operation. These issues can result in device failure. Proper use of the preform cutting tool will result in square cut preforms, i.e., using the alignment guides to square-up the solder material. A commercially purchased solder preform would be proportionally shaped to the component that was being soldered (it would be squared).

The cleaving process poses challenges in that the cutting blade 1 is not self-aligned and easily guided though the hard solder preform material 2 during the cleaving process. The cutting blade 1 therefore may easily slip with respect to the material being cut when receiving an impulsive force. Indeed, the blade 1 can easily slip or jump when struck with the hammer.

In light of the foregoing, a die attach solder preform cutter, and method of using the same are provided for easily and accurately cleaving die attach solder preform material. The preform cutter is a small, light-weight, portable tool, and can be carried in the user's hand to their work location. The cutter requires no electricity or batteries. It can be used on any work surface, even in a limited amount of space. The cutter can be easily stored in a drawer or cabinet when not being used. This tool does not require specially machined stamps and dies to produce custom sized preforms. Producing preforms with the cutter is achieved without the use of chemicals.

The die attach solder preform cutter is a compact tool used to cut small pieces of thin, brittle, solder preform material to custom shapes and sizes for optimal die attach material in electrical device(s). The cutter uses a sharp cutting blade, being quickly struck with a hammer or other weighted object on a thin sheet of solder that lies on a flat surface beneath the blade; this action cleaves the solder to a desired dimension. One typical solder that can be cleaved with this preform is an 80Au/20Sn alloy, discussed above, with a thickness of 0.001" to 0.004", and a width not exceeding 3.5" (there may be no limiting factor for material length, as typically they come in long strip, or even on rolls). The tool will cleave or cut other solder alloys in the same manner. It can also cut other solders commonly used as preforms (e.g. AuGe, AuSi, 63SN/37Pb, SAC, 95Pb/5Sn) in the same manner. This tool is envisioned to cut rectangular or square shaped solder preforms to specific sizes that are used as die attach for packaging electronic devices. Angled cuts are also possible with judicious arrangement of the blade and material if desired.

Figure 3A:
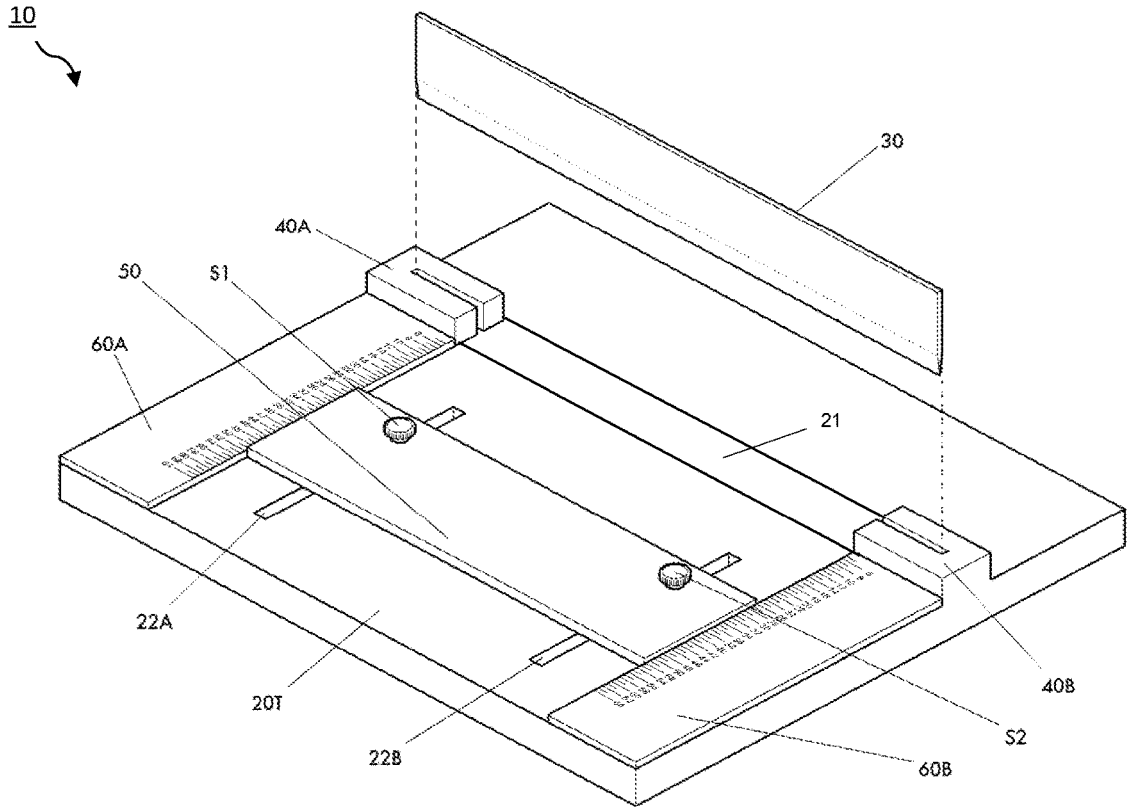
FIGS. 3(A)-3(D) show a die attach solder preform cutter according to an embodiment of the present invention, where
Figure 3B:
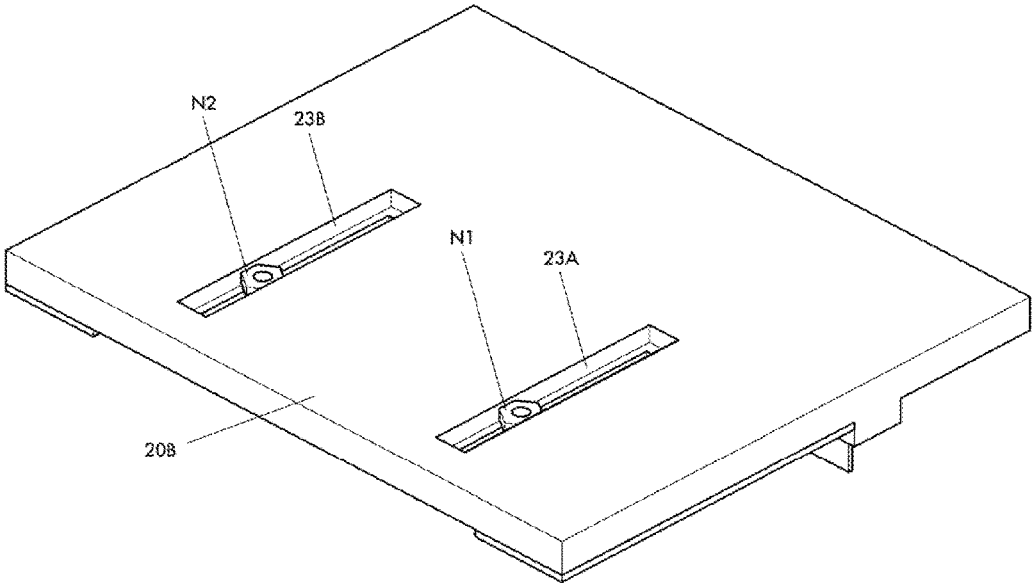
Figure 3C:
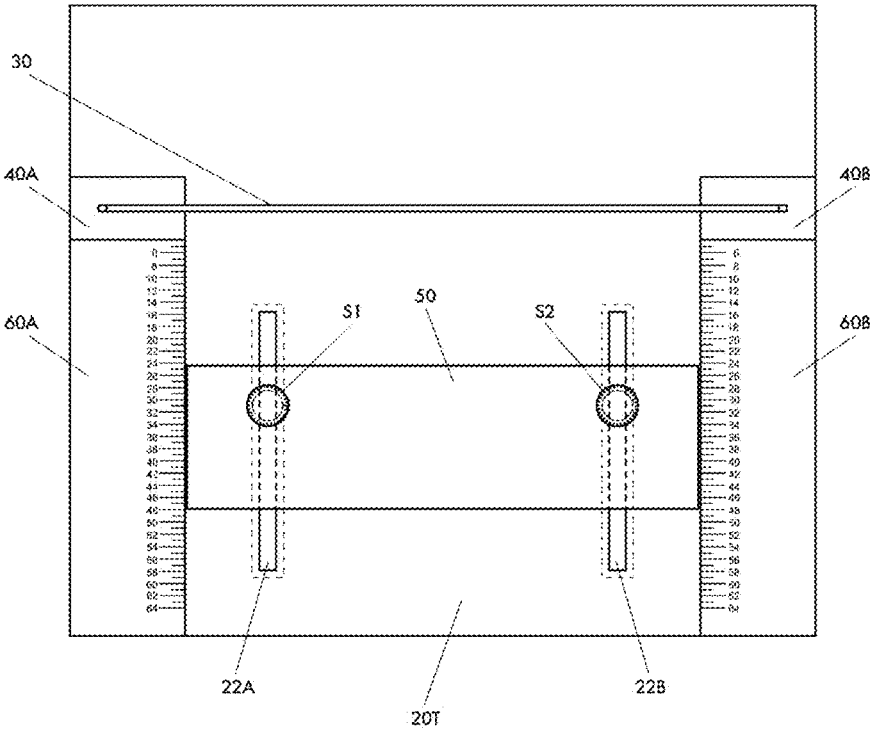
Figure 3D:
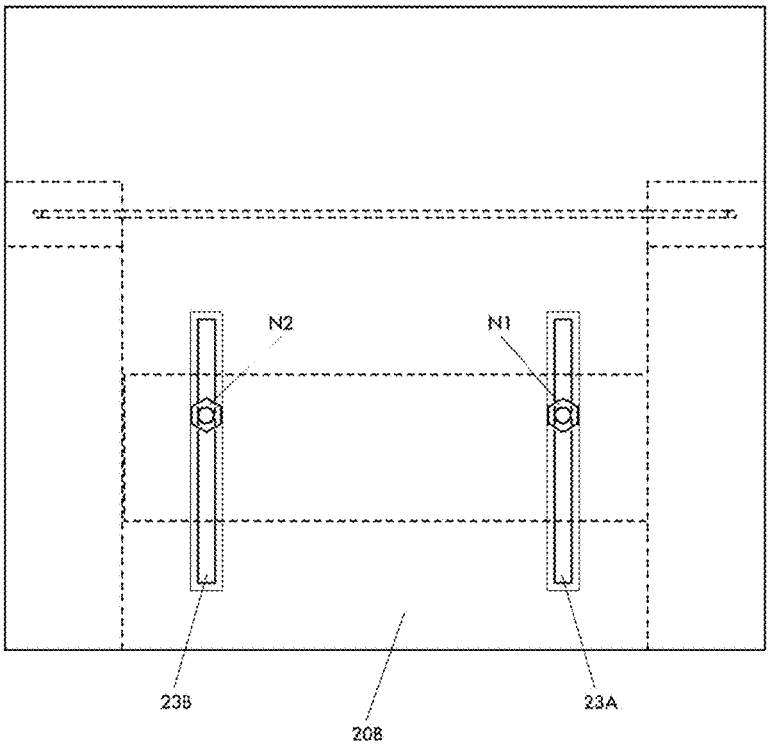

FIGS. 3(A)-3(D) show a die attach solder preform cutter 10 according to an embodiment of the present invention. FIG. 3(A) shows a top isometric view, FIG. 3(B) shows a bottom isometric view, FIG. 3(C) shows a top plan view, and FIG. 3(D) shows a bottom plan view thereof. In general, the cutter 10 includes a base 20, a cutting blade 30, a pair of raised blocks 40, an adjustable stop 50 and a linear scale 60.

The base 20 supports and holds the material to be cut. In the figures, the top and bottom surfaces of the base are identified as 20T and 20B, respectively. It is important for the cutter's base to be smooth and flat so the solder can lay flat on the base, and the blade contacts the solder in a perpendicular manner. If it is not flat, the solder probably would not cleave cleanly; a non-planar surface could cause the solder to crease (the solder needs to remain flat for use). Thus, the base should not have a groove or channel cut into it that the blade could fall into once it passes through the cleaved solder. If the blade were to fall into a channel like this it could drag the edges of the solder down and create a rolled edge (or bend) on the solder.

The cutting blade 30 has have a sharp, thin, even edge where it contacts the solder so the cut results in a clean line. For hard brittle solders (e.g., AuSn), the blade cleaves, or snaps the solder into two pieces once the downward striking force is applied to its surface, and before it actually passes through the metal. Cutting brittle preform solder to size cannot be achieved using traditional scissors or slicing action because the solder would shatter rather than separate in a clean line. For softer solder (e.g., SnPb, SAC, etc.), cutting can be achieved as the blade is pushed into and through the solder to make the clean separation.

The blade must be hard (or stiff) enough so that it does not bend or deform when a downward striking force is applied to it. The blade needs to stop at the surface of the base once it has passed through the solder so the solder maintains a flat preform profile. It is important that the entire blade's cutting edge contacts the surface of the solder when downward force is applied. (This is especially true for brittle solder). The weight of the blade resting on the solder will help to hold the solder in place during the cleaving operation.

The blade must have an even edge where it contacts the solder, and it needs to have a sharp edge so the "snap" will result in a clean line. A single edged blade is preferred. The blade must be hard (or stiff) enough so that it doesn't bend or deform when a downward striking force is applied to it. The hardness of a standard razor blade metal has proved to be adequate. The blade should be ground to form a thin cutting edge that contacts the solder. For gold/tin solder the blade might not need to be so sharp but the metal would need to be very thin and very stiff. However, for cutting softer solders the blade would need to have a sharp cutting edge, because it would cut soft solder rather than cleave or "snap" it apart. One exemplary blade that may be used is a 4.625"×0.61"×0.035" available from American Cutting Edge in Centerville, Ohio; Part number F-046252. The single edged blade can easily be replaced if it gets dull, damaged, or worn.

Cleaving the solder preform is not achieved using sideways (or rotational) cutting motion. Moving a blade across brittle solder will shatter the solder rather than cut it, while moving a blade across soft solder deforms the edge, and causes it to stretch and/or roll. Also, moving a blade across soft or hard solder in a sideways motion may allow the blade to run off track and deviate from a straight line, which would result in a crooked uneven edge.

The pair of small raised blocks 40 hold the cutting blade 30 in place. The raised blocks 40 (40A, 40B) are positioned proximate to the adjustable stop which enables a measured length of the material to be cut. They are spaced apart on the base 20 to hold the cutting blade 30, with block 40A to the left and block 40B to the right. More particularly, each of the raised blocks 40 includes a slot sized to accommodate the cutting blade 30 and constrain the cutting blade to vertical movement in order to maintain the squareness of the cutting blade with respect to the base for cutting material.

The adjustable stop 50 is positioned forward of the cutting blade which is configured to be moved so as to set the length of the material to be cut by the cutting blade. The stop 50 may be configured to slide relative to the base 20. The front portion of the material to be cut abuts the adjustable stop 50, while the rear portion of the material to be cut lies behind the cutting blade 30.

The linear scale 60 is positioned proximate to the adjustable stop which enables a measured length of the material to be cut. The scale provides a measurement of length from the cutting blade to the adjustable stop 50. The scale 60 may include graduated indicia of length, for example, in English and/or metric units of length (such as in inches or millimeters). The scale 60 scale may be provided on the base 20 on one of both sides of the stop 50. Two such scales 60 (60A, 60B) are shown in the FIG. 3(A). The indicia may be formed (e.g., embossed or printed) on the scales in 1:1 ratio onto clear material, in reverse, so the indicia would be face down when mounted on the base. This prevents the indicia from being worn or rubbed off due to handling. In some embodiments, the scales may be designed using a computer-aided drafting software (such as AutoCAD) to create the scales by drawing lines and placing text (numbers).

The preform cutter 10 utilizes a quick downward blow of the sharp edged cutting blade 30 to cleave a larger piece of preform solder material into smaller pieces. The entire blade edge should evenly contact the solder while the downward force is applied. A hammer therefore may be used to strike or tap the top edge of the cutting blade 30 in order to initiate cleaving of the material. For instance, a light tap with the 4 oz. weight may be adequate for cleaving brittle solder. Softer solders may require a harder tap with the hammer, or perhaps a heavier weight. Alternatively, some other weighted object could be used to strike a quick downward blow to the center of the cutting blade; the strike does not need to be very hard. It is the force of the blade, evenly distributed across the blade, which cleaves the solder preform. The blade 30 must be perpendicular to the solder preform and base 20 to achieve the cleave.

According to one particular embodiment, the preform cutter 10 may be composed of a flat plastic base, an adjustable plastic cutting guide, a single edged cutting blade, two scales, two 4-40 ⅜" screws, two 4-40 nuts, and six 2-56 3/16" screws.

The base 20 may be formed of a plastic materials, such as polycarbonate plastic, for example. The overall dimensions of the base 20 can be 110 mm×110 mm×8 mm. Incorporated into the base are two parallel slots 22 (22A, 22B) that connect the adjustable guide 50 to the base 20. Thumb screws S1, S2 can be provided to allow the user to more easily tighten/untighten the screws. Although, these could be replaced with conventional screw types, e.g., Phillips or flathead screws. The two thumb screws S1, S2 may be joined with nuts N1, N2; both may be 4-40 threads for instance. It is possible to have a single slot 22 for permitting the guide 50 to slide; although it will be appreciated that having parallel slots 22A, 22B may ensure greater squareness.

On the back side of the base 20 there are recessed slots 23A, 23B to capture nuts N1, N2 that hold the thumbscrews S1, S2 to the guide 50, thus allowing the base to rest flat on a surface, such as a table. The recessed slots 23 are flush with the bottom surface 20B of the base to ensure the cutter will lay flat on the surface. The slots 22A, 22B (on the front) may be 3×45 mm, and the recessed slots (on the rear) may be 6.5 mm×55 mm, for instance To adjust the guide 50 the user would loosen the thumbscrews S1, S2 just enough that the guide 50 will slide, then tighten the thumb screws S1, S2 once the guide 50 is aligned with the scales 60 indicating the size they want to cut a preform. The nuts N1, N2 are preferably fully captured in the recesses 23A, 23B (on the bottom side of the cutter) so that they do not interfere with operation of the cutter. Tightening the thumb screws S1, S2 pulls the nuts N1, N2 against the shoulders of recesses 23A, 23B thus fixing or locking the position of the guide 50 with respect to the base 20.

The guide 50 may be 89×25×2.25 mm, for instance. A pair of holes in the guide 50 with a diameter of 2.8 mm can accommodate the shank of thumbscrews S1, S2. It was discovered that the placement of the two thumbscrews S1, S2 that hold the adjustable stop 50 impact use. Initially, in a prototype, these screws had been positioned centrally, i.e., between the two edges of the stop 50. In that position, tightening the screws causes the edge of the stop 50 (closest to the blade) to raise slightly. The small gap can allow the thin pieces of solder to slide under the stop 50, which hinders proper measurement of the solder material. The optimum position of the thumbscrews S1, S2 has been found to be nearer to the edge of the adjustable stop 50 that is closest to the blade 30.

The raised blocks 40A, 40B are formed on the top side with a slot or groove to hold the cutting blade 30 perpendicular to the base 20. A slight tolerance, for example, between about 0.002" and 0.004" may be incorporated to constrain the blade in a nearly perpendicular position, yet allow it to move freely within the blocks in a vertical motion to complete the cleaving process.

In some embodiments, the raised blocks 40 may be integrally formed with the base 20. The base 20 and/or raised blocks 40 of preform cutter can be manufactured by a three-dimensional (3D) printing process with polycarbonate plastic, for instance. Of course, one or both of these could be formed by other means, and/or with other materials. They could be molded out of a variety of plastics, could be 3D printed using other materials, or it could be machined out of plastic or metal. 3D printing requires a certain printed volume to be stable and print accurately. A 5 mm height, for example, could be constant to keep the cutting blade upright, but the footprint size could be reduced depending on the manufacturing material.

The overall dimensions of the cutting guide 50 may be 89 mm×25 mm×2.25 mm, in one particular embodiment. Two 2.8 mm (0.1102") holes are drilled in the cutting guide to attach the guide to the base using two 4-40 ⅜" screws and nuts. The guide 50 can easily be adjusted to cut numerous rectangular sized preforms.

The linear scales 60 can be formed of two thin strips of aluminum 10 mm×69 mm (approx. 1 mm thick). The scales 60 can be fastened to the base 20 using six 0.089" holes drilled into the base 20 for accommodating 2-56 screws, for instance.

In some embodiments, a thin piece of a hard material 21, such as metal (e.g. aluminum) or ceramic plate, may be attached to and flush with the cutter base 20 in between the raised blocks 40 that hold the cutting blade 30. This provide a more stable surface for cutting the solder preforms, and would prevent damage to the base. The overall size of the preform cutter could be smaller or larger depending on the size of the cutting blade to be used, the size of the stock solder material that will be cut, or the requirements for the size of the finished preform.

The preform cutter design can cleave rectangular solder preforms from strips, ribbons, or rolls of solder in widths up to 3.5" wide (89 mm). The tool will cut solder of typical die attach thickness (e.g. 0.001"-0.002"), however, it should cut thicker solders by using slightly more force. The length of the strip is not limited because there is nothing on the back edge of the base or blade to limit the length; the extra material will simply extend over the back edge of the base.

Figure 4A:
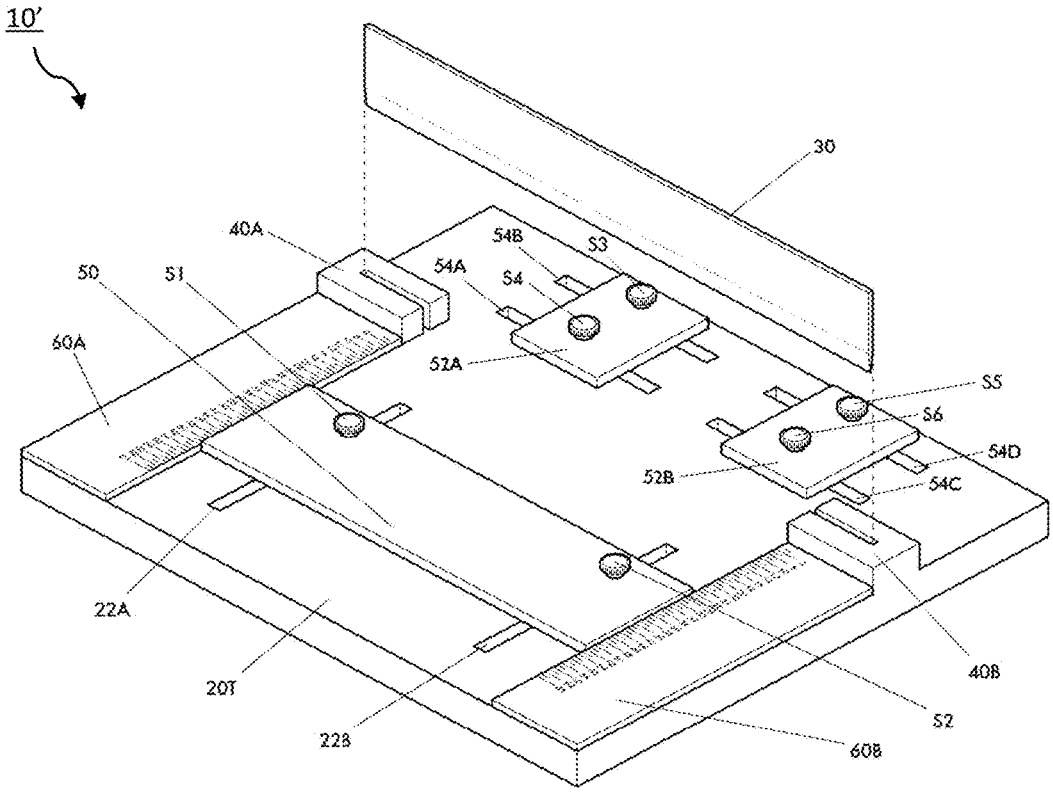
FIGS. 4(A)-4(D) show another die attach solder preform cutter which includes the addition of two adjustable lateral alignment guides that ensure the stock solder strip aligned perpendicular with the cutting guide and blade according to an embodiment of the present invention, where
Figure 4B:
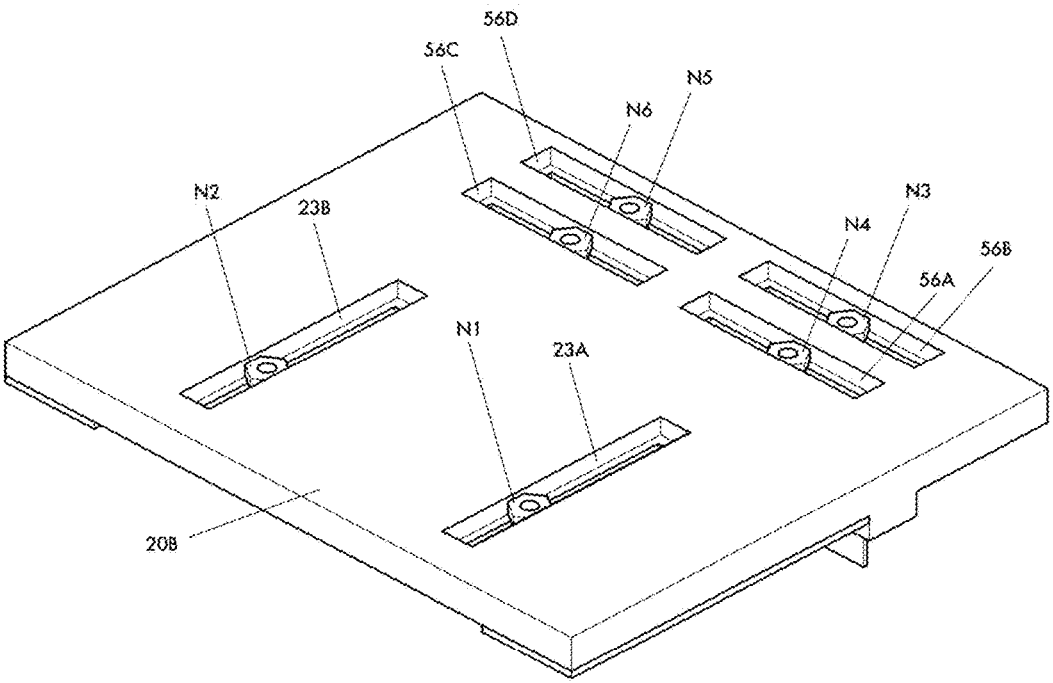
Figure 4C:
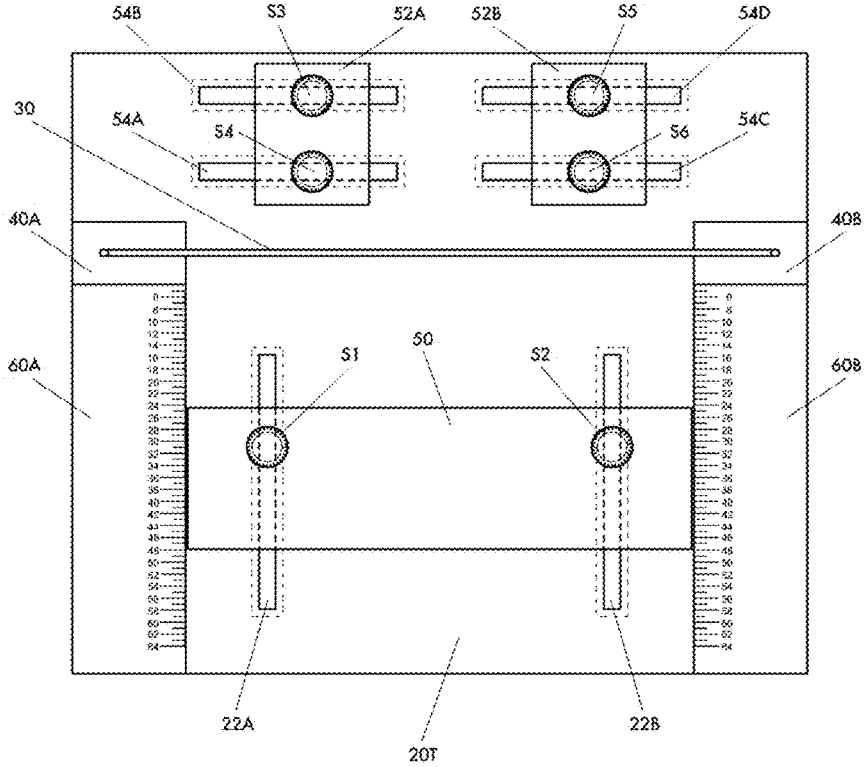
Figure 4D:
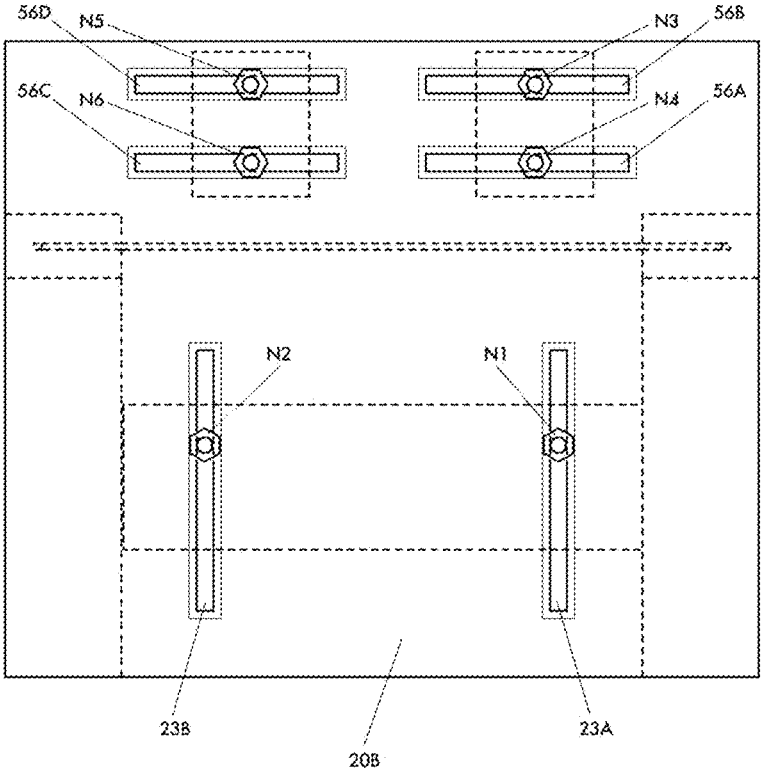

FIG. 4(A)-4(D) show another die attach solder preform cutter 10' according to an embodiment of the present invention. FIG. 4(A) shows a top isometric view, FIG. 4(B) shows a bottom isometric view, FIG. 4(C) shows a top plan view, and FIG. 4(D) shows a bottom plan view thereof. Many of the elements of the cutter 10' are the same as the die attach solder preform cutter 10 depicted in FIGS. 3(A)-3(D) and thus they will not be described again here. The cutter 10' includes the addition of two adjustable lateral alignment guides 52 (52A, 52B) that ensure the stock solder strip aligned perpendicular with the blade 30 and cutting guide 50. The lateral guides 52 (52A, 52B) can be attached with the same type of hardware, and in the same manner as the cutter guide 50.

It is possible to have a single slot 54 for permitting each guide 52 to slide; although it will be appreciated that having parallel slots 54A, 54B, as shown may ensure greater squareness. Thumb screws S3, S4, S5, S6 can be provided to allow the user to more easily tighten/untighten the screws (similar to S1 and S2). Although, these could be replaced with conventional screw types, e.g., Phillips or flathead screws. The two thumb screws S3, S4, S5, S6 may be joined with nuts N3, N4, N5, N6; both may be 4-40 threads, for instance. It is possible to have one slot 54 for permitting each of the guides 52A, 52B to slide; although it will be appreciated that having parallel slots 54A, 54B and 54B, 54D may ensure greater squareness.

On the back side of the base 20 there are recessed slots 56A, 56B, 56C, 56D to capture nuts N3, N4, N5, N6 that hold the thumbscrews S3, S3, S5, S6 to the guides 52A, 52B. The recessed slots 56 are flush with the bottom surface 20B of the base to ensure the cutter will lay flat on a surface, such as a table.

Figure 5:
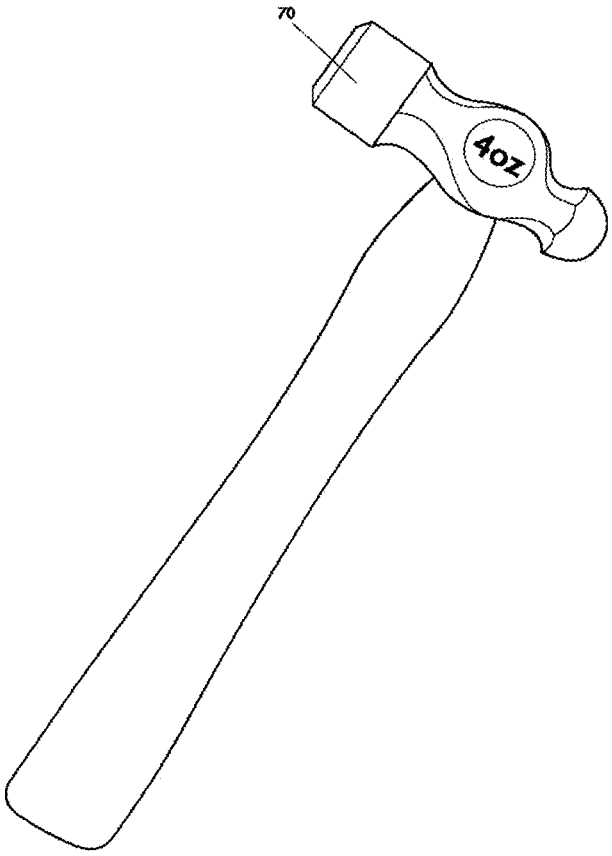
FIG. 5 show a hammer which can be used with various embodiments of the die attach solder preform cutter to strike the cutting blade to cleave solder preform material.
Figure 6A:
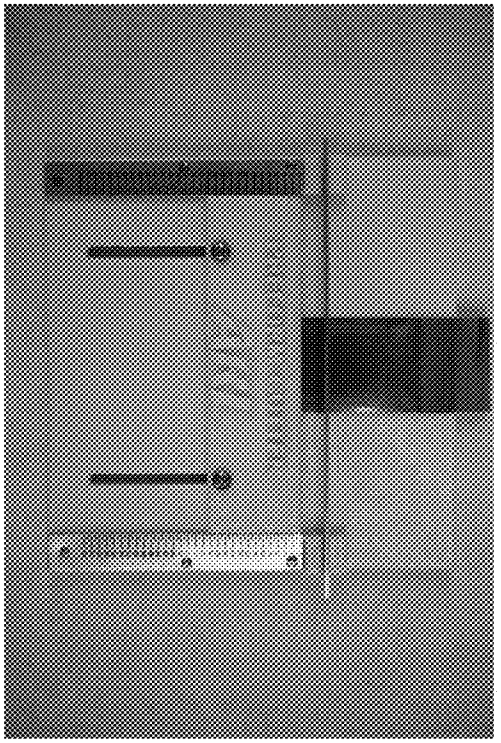
FIGS. 6(A)-6(C) are photographs showing a prototype die attach solder preform cutter in cleaving preform material of various shapes and sizes.
Figure 6B:
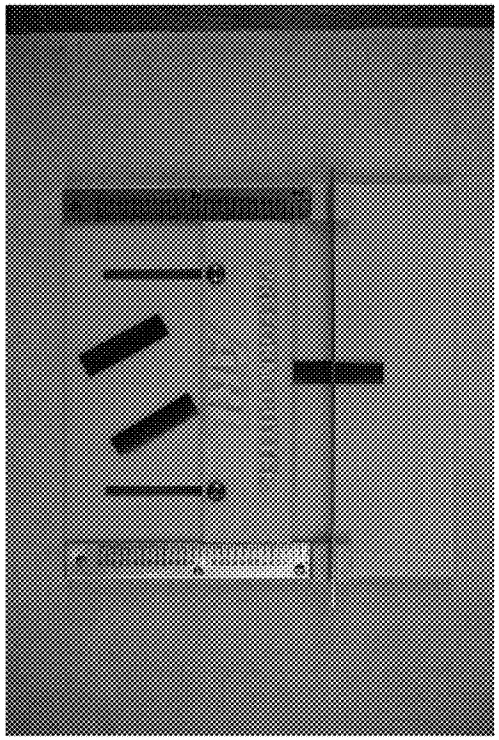
Figure 6C:
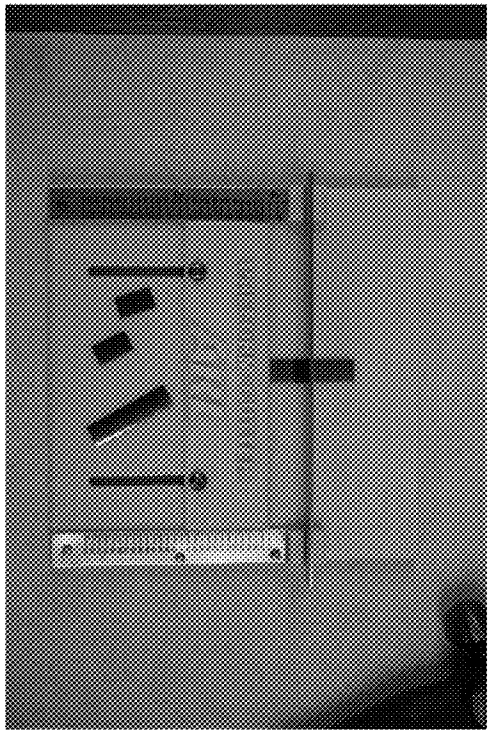

FIGS. 6(A)-6(C) are photographs showing a prototype of the die attach solder preform cutter in cleaving preform material of various shapes and sizes. This prototype was first disclosed in the technical report by Dimeji Ibitayo, Gail Koebke, Damian Urciuloi, and C. Weslet Tipton, titled, "Fabrication of High-Voltage Bridge Rectifier Modules for Pulse Power Applications," published by U.S. Army Research Laboratory, ARL-MR-0877 (September 2014); FIG. 5, page 6. This prototype cutter is considered an embodiment of the present invention.

It is noted that in this prototype the blocks do not fully surround the sides of the cutting blade. As such, the cutting blade could slide laterally during the cleaving process. Care taken by the user to confine the blade within the blocks during the cleaving process prevents the blade from sliding laterally. The narrow slot width within the blocks prevents the blade from rotating to a degree that would cause poor cleaving. Nonetheless, this prototype cutter maintained the required squareness of the cleave. The raised blocks configuration in the embodiments illustrated in FIGS. 3 and 4, surrounding the side edge of the cutting blade eliminates misplacement of the blade.

To cut preforms to a particular size the user must make one or more cuts for each preform. A first set of cuts may be made to square the front portion of the material, with additional cuts resulting in the finished dimension of two parallel sides of the rectangular preform by the width of the initial strip, ribbon, or roll. A second set of cuts will complete the cutting process and result in the dimension for the other two parallel sides of the rectangle.

The linear scale of the cutter allows the user to set the position of the adjustable guide with the desired dimension of the cut. The screws on the cutting guide can be loosed so that the adjustable guide will slide with respect to the base so the exact length of material to be cut is set. Then, the user can then tighten the screws to lock the guide in place. The cutting blade can be lifted so that a piece of solder preform material can be slid in the area under the blade. Optimum placement of the strip is under the center portion of the blade. The solder material is firmly pushed against the cutting guide edge, to ensure that the edge of the solder is straight and flush against the guide. The blade is repositioned in the raised blocks that hold the blade in place and ensure it is sitting level across the solder to be cut. The blade can then be pressed down gently against the solder materials. The weight and/or frictional engagement of the cutting blade with the material to be cut and the raised blocks also helps to maintain the alignment of the cutting blade with respect to the material prior to cutting. The solder that is visible between the blade and the cutting guide will be the width of the cut strip once the cut is made, which corresponds to the dimension on the linear scale.

FIG. 5 show an exemplary hammer 70 which may be used with various embodiments of the die attach solder preform cutter (10, 10') to strike or tap the top edge of the cutting blade 30 in order to initiate cleaving of the material. It may be 4 oz. in weight, for instance. Although, other sized and types of hammers may also be used.

In FIG. 6(A), the adjustable guide is initially set to cut a 6 mm strip for making a first set of cuts. While the piece of solder in is held in place, the user can take the hammer or weighted object to gently tap the center of the top edge of the blade with a quick downward blow. This motion should be sufficient to initiate cleaving of the material. A subsequent blow may be needed if the solder material does not cut using a little more force. AuSn solder is brittle and snaps apart easily with a gentle tap to the blade. Softer, thicker solders such as SAC and SnPb may require a little more force to cut through, and could require several strikes with the weighted object.

Once the first strip is cut to the desired width the user may continue to cut additional strips of the same size, or move on to the next cut step. The processes can be repeated if additional strips are needed, starting with the step of lifting the blade to slide the solder under it, and continuing until the desired number of strips have been cut. FIG. 6(B) shows the result of the first set of cuts.

To make the second set of cuts, which results in the finished sized preform, the screws of the alignment stop can be loosened again. The cutting guide can be aligned with the dimensions on the scales that are required for the other two sides of the finished rectangular preform. As with the first cuts, the cutting blade is lifted and the previously cut strip(s) of solder material can be slid under the blade. Optimum placement of the strip is under the center portion of the blade. The solder strip is pushed firmly against the cutting guide edge to ensure that the edge of the solder strip is straight and flush against the guide. The blade is repositioned in the blocks to hold the blade in place and ensure it is sitting level across the solder to be cut, then press the blade down gently. The weight and/or frictional engagement of the cutting blade with the material to be cut and the raised blocks also helps to maintain the alignment of the cutting blade with respect to the material prior to cutting. The solder that is visible between the blade and the cutting guide will be the finished preform once the cut is made.

While the piece of solder is held in place, the user can take the hammer or weighted object to gently tap the center of the top edge of the blade with a quick downward blow. FIG. 6(C) shows the result of the second set of cuts and the finished cut preforms. The processes of pushing the strips against the cutting guide and cutting each preform are continued until all the strips are cut.

Figure 7A:
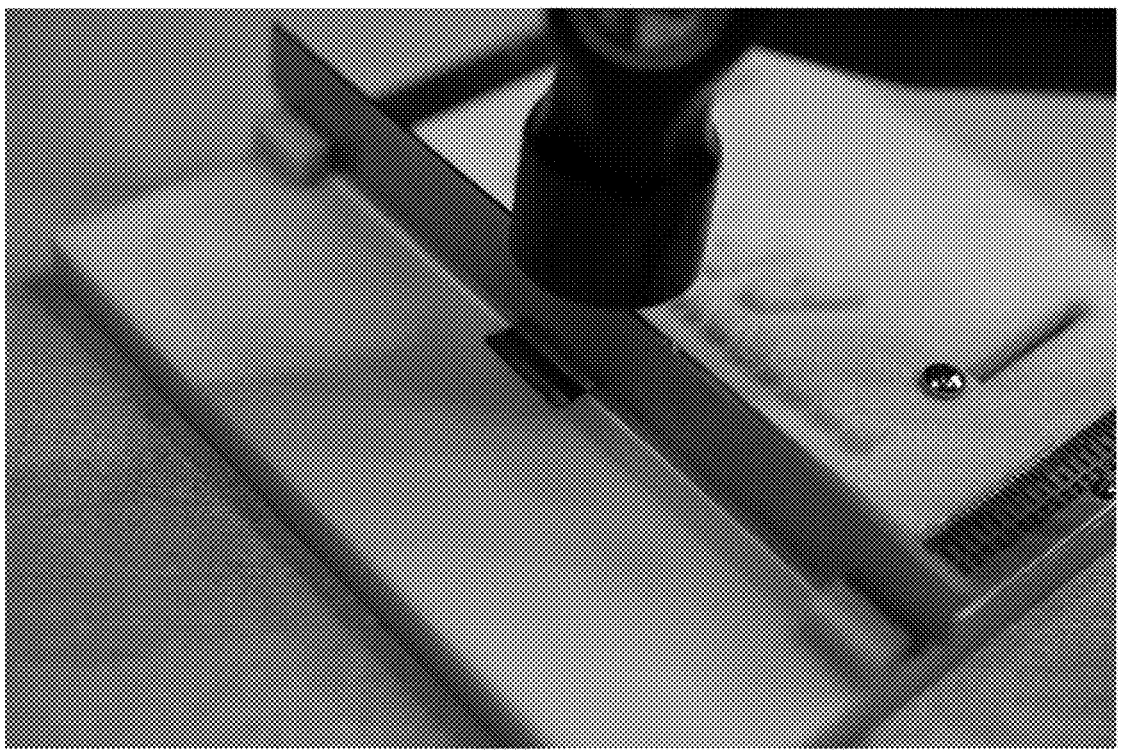
FIGS. 7(A)-7(B) are photographs showing using the prototype die attach solder preform cutter.
Figure 7B:
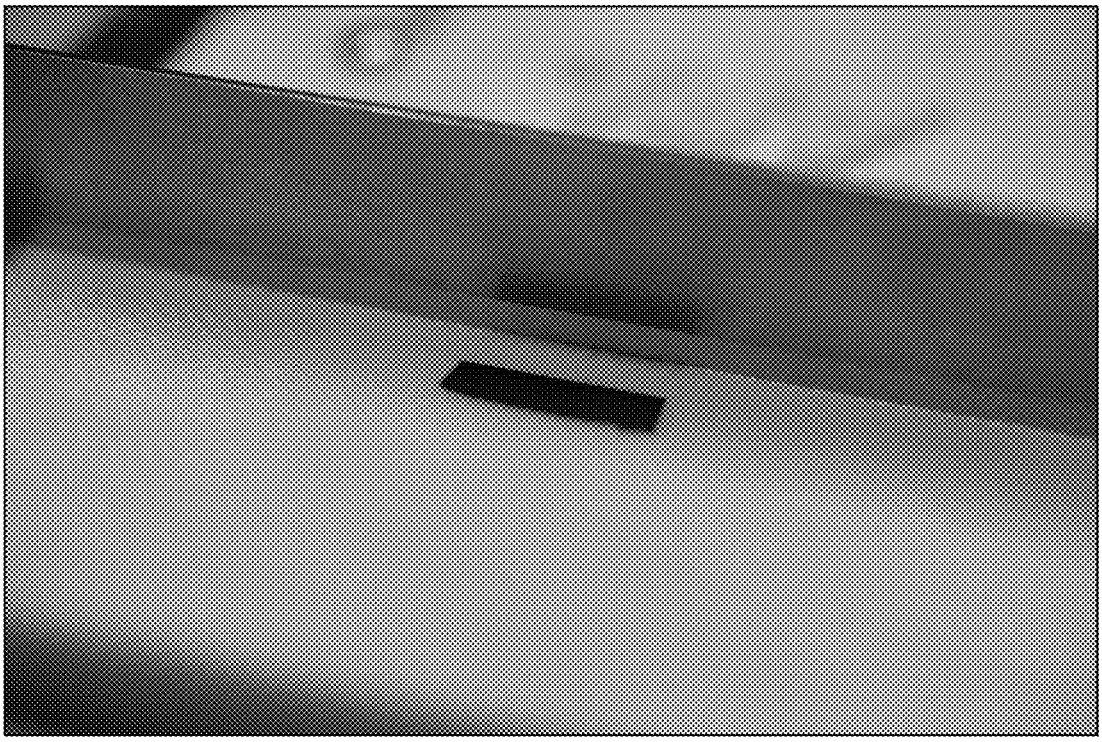

FIGS. 7(A) and 7(B) are photographs showing using the prototype die attach solder preform cutter. FIG. 7(A) shows the top edge of the cutting blade immediately before being tapped with a hammer to initiate cleaving of the solder preform material. FIG. 7(B) shows the solder preform material after it has been cleaved. As will be appreciated, the cutting blade does not travel through the material to cut the material in the conventional sense. Indeed, there may be a small gap between the cutting blade and the base after the material has been cleaved, as shown in this photograph.

The preform cutter can benefit most any institution (e.g., business, academia, research lab, etc.) where small quantities of various size devices are packaged. The tool offers the ability to cut custom size solder preforms as needed from larger pieces of stock, rather than ordering large quantities of pre-cut material to meet manufacturer's minimum orders. More, this tool is useful for any R&D device packaging lab where small quantities of ever changing sized devices are packaged.

The preform cutter allows the user to cleave stock solder materials on an ad hoc basis in the form of ribbons, rolls, or small sheets, which can easily be cut down to small sizes. The preform cutter may be used to cut small quantities of 0.002" 80Au20Sn preforms from 1" ribbon stock for electronic device research and development applications. The optimum size of a solder preform used for die attach is dictated by the size of the device that is being soldered to a substrate. There is a tremendous cost saving for purchasing ribbon solders over purchasing custom solder preforms, for which there is generally a minimum order. In addition to the cost savings, the user can custom cut preforms as needed in small quantities, and complete the process in a matter of minutes. It is more cost effective to stock ribbon or small sheets of solder, lead time is eliminated, and the user can cut the quantity of preforms that are required for the job. Additionally, the die attach quality from preforms made using this tool is as good as the results seen from stamped or die-cut manufactured preforms.

The cutter utilizes a single edged blade to snap a break in various types of solders used for die attach (e.g. AuSn, AuGe, AuSi, SnPb, SAC). It does not require custom manufactured fixed sized stamp and die tooling. A variety of rectangular sized preforms can be cut with this tool. Lead time and high cost set-up charges required by manufacturers are eliminated, as is the minimum order that is required to custom manufacture preforms. Cutting only the number of preforms the user needs, from stock that is on hand, reduces the cost of preforms. The simplicity of this cutting tool allows the user to accurately cleave solder preforms in a matter of minutes. This tool may be capable of cutting other solders alloys that are different thicknesses used for die attach.

The die attach preform cutter has been used to accurately cleave small quantities of 0.002" 80Au20Sn (gold/tin or AuSn) solder preforms of various sizes. In addition to cleaving AuSn, the cutter can cleave or cut other known solders typically used for die attach (e.g. AuGe, AuSi, SnPb or SAC). The preforms are used to attach electronic devices to substrates.

With the ability to accurately cleave solder preforms in small quantities from stock of ribbons, sheets, or rolls, time and money will be saved. The preform cutter eliminates paying for a manufacturer's set-up charge (i.e., thousands of dollars), and it eliminates the lead time of several weeks. Additionally, the preform cutter eliminates the manufacturer's requirement of purchasing a minimum quantity, which may be hundreds more than are needed.

The preform cutter has been successfully used to cut gold-tin (AuSn), tin-lead (SnPb), and tin-silver-copper (SAC) die attach solder preforms for a bi-directional solid state circuit breaker module, 15 kV rectifier modules, and various single device packages built for testing and analysis.

Figure 8:
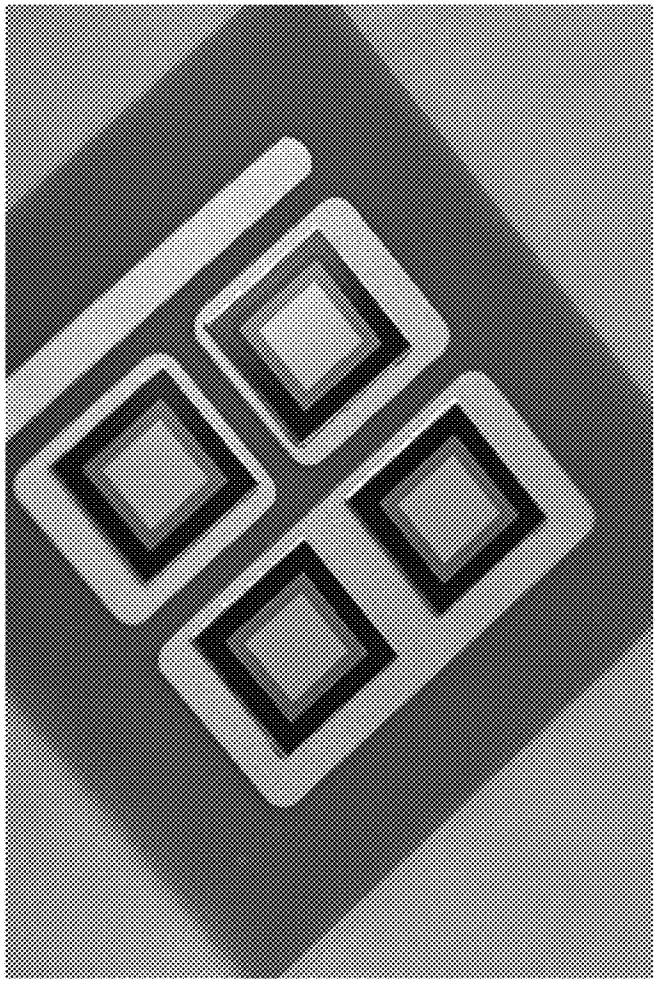
FIG. 8 is a photograph showing electronic diode devices attached with solder preforms which were cleaved with the die attach solder preform cutter.

FIG. 8 is a photograph showing electronic diode devices attached with solder preforms which were cleaved with the die attach solder preform cutter. More particularly, four 1 $cm^2$ diodes are attached with AuSn preforms that were cleaved using the preform cutter. Each die attach device has an optimum size preform requirement. Industry standard dictates a preform size of 85% to 90% of the device size for die attach and the preform cutter 10 can readily accommodate such tolerances. A true square-sided preform would be optimum. The adjustable stop and lateral cutting guides on the preform cutter ensure (nearly) square cut preforms.

In some embodiments, the cutter may be a standalone tool. Although, in other embodiments, it may be included in a kit that comprises the cutter, one or more cutting blades as well as an optional hammer or weighted object for striking the cutting blade for cleaving solder preform material. Solder preform materials may also be included in the kit. The kit may include a carrying case and instructions.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, and to describe the actual partial implementation in the laboratory of the system which was assembled using a combination of existing equipment and equipment that could be readily obtained by the inventor, to thereby enable others skilled in the art to best utilize the invention and various embodiments with various modifications as may be suited to the particular use contemplated.

While the foregoing is directed to embodiments of the present invention, other and further embodiments of the invention may be devised without departing from the basic scope thereof, and the scope thereof is determined by the claims that follow.

The invention claimed is:

1. A kit comprising:

a cutter to cut a die attach solder preform material comprising:

a base;

a pair of raised blocks spaced apart on the base with each having a slot sized for accommodating a cutting blade configured to cut the die attach solder preform material to be cut, constrain the cutting blade to vertical movement only, and maintain the squareness of the cutting blade with respect to the base for cutting the material;

an adjustable stop positioned forward of the cutting blade which is configured to be moved so as to set the length of the material to be cut by the cutting blade; and a linear scale positioned proximate to the adjustable stop which enables a measured length of the material to be cut, wherein said cutting of the die attach solder preform material is initiated by an impulsive force that generates a crack which propagates in the die attach solder preform material ahead of the cutting blade in the direction of cutting, and wherein the cutting blade is unbiased and readily slides with respect to the blocks, but is not attached to the base for movement, while cutting the die attach solder preform material, solder preform material, one or more removable cutting blades, and a hammer for hitting a cutting blade to provide the impulsive force for cutting the solder preform material, wherein the hammer is not mounted, coupled or attached to the cutter.

2. The kit of claim 1, wherein the base includes one or more slots and the adjustable stop includes corresponding one or more projections which slide in the at least one slot of the base.

3. The kit of claim 2, wherein the one or more projections accommodate a thumbscrew which engages a corresponding nut held on a slot on a bottom surface of the base.

4. The kit of claim 1, further comprises one or more adjustable lateral guides which maintain the material to be cut in substantially perpendicular alignment with respect to the cutting blade.

5. The kit of claim 4, wherein the one or more adjustable lateral guides are positioned rearward of the cutting blade.

6. The kit of claim 4, wherein the base includes one or more slots and the one more adjustable lateral guides includes corresponding one or more projections which slide in the at least one slot of the base.

7. The kit of claim 6, wherein the one or more projections accommodate a thumbscrew which engages a corresponding nut held on a slot on a bottom surface of the base.

8. The kit of claim 1, further comprising the cutting blade which is removable from the cutter.

9. The kit of claim 8, wherein the cutting blade includes a single cutting edge.

10. The kit of claim 1 wherein the weight and/or frictional engagement of the cutting blade material with the material to be cut and the raised blocks of the cutter helps maintain the alignment of the cutting blade with respect to the material prior to cutting.

11. The kit of claim 1 wherein the cutter further comprises: one or more lateral guides which maintain the material to be cut in substantially perpendicular alignment with respect to the cutting blade.

12. The kit of claim 1 wherein the base of the cutter beneath the cutting blade and material cut is flat and level so as to maintain the material flatness when the material is cut.

13. The kit of claim 12, further comprises a plate attached to and flush with the base below the cutting blade.

14. The kit of claim 1 wherein the base and raised blocks of the cuter are integrally formed by 3D printing.

15. The kit of claim 1 wherein the cutter is configured to cut solder preform material about 0.001" to 0.004" in thickness.

16. The kit of claim 1, wherein the hammer is 4 oz. in weight.

17. The kit of claim 1, wherein the solder preform material is selected from the group consisting of AuSn, AuGe, AuSi, SnPb and SAC.

18. A method of cutting solder preform material using a cutter, comprising:

a base;

a pair of raised blocks spaced apart on the base with each having a slot sized for accommodating a cutting blade configured to cut the die attach solder preform material to be cut, constrain the cutting blade to vertical movement only, and maintain the squareness of the cutting blade with respect to the base for cutting the material;

an adjustable stop positioned forward of the cutting blade which is configured to be moved so as to set the length of the material to be cut by the cutting blade; and a linear scale positioned proximate to the adjustable stop which enables a measured length of the material to be cut, wherein said cutting of the die attach solder preform material is initiated by an impulsive force that generates a crack which propagates in the die attach solder preform material ahead of the cutting blade in the direction of cutting, and wherein the cutting blade is unbiased and readily slides with respect to the blocks, but is not attached to the base for movement, while cutting the die attach solder preform material, the method comprising: inserting solder preform material into the cutter; and cutting said solder preform material to a predetermined length.

19. The method of claim 18, wherein the solder preform is formed of a gold and tin alloy.

20. The method of claim 18, wherein the solder preform is a ribbon material.

21. The method of claim 18, further comprising: using a hammer to hit the cutting blade to provide the impulsive force for cutting the material, wherein the hammer is not mounted, coupled or attached to the cutter.

22. The method of claim 18, further comprising:

inserting the cut solder preform material back in the cutter; and cutting the cut solder preform material again.

23. The method of claim 18, further comprising:

replacing an old cutting blade in the cutter with a new cutting blade, wherein the old cutting blade is readily removed from the blocks and the new cutting blade is inserted into the blocks without assembling or disassembling any other parts of the cutter.

* * * * *